US009167918B2

(12) United States Patent
Leyden

(10) Patent No.: US 9,167,918 B2
(45) Date of Patent: Oct. 27, 2015

(54) SECURITY SYSTEM FOR ARTICLES DISPLAYED ON AN ELONGATE ROD

(71) Applicant: Se-Kure Controls, Inc., Franklin Park, IL (US)

(72) Inventor: Roger J. Leyden, Inverness, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 21 days.

(21) Appl. No.: 14/151,255

(22) Filed: Jan. 9, 2014

(65) Prior Publication Data

US 2015/0189999 A1 Jul. 9, 2015

(51) Int. Cl.

| | |
|---|---|
| ***A47F 5/08*** | (2006.01) |
| ***E05B 73/00*** | (2006.01) |
| ***A47F 7/14*** | (2006.01) |

(52) U.S. Cl.

CPC ..... *A47F 7/143* (2013.01); *A47F 5/0823* (2013.01); *A47F 5/0861* (2013.01); *A47F 5/0876* (2013.01)

(58) Field of Classification Search

CPC ..... A47F 5/006; A47F 13/00; A47F 5/0861; A47F 1/128; A47F 5/0823; A47F 5/0869; A47F 5/0846; A47F 5/0876; A47F 7/173; A47F 5/0807; A47F 5/0815; A47F 5/083; A47F 8/08; A47F 5/0838; E05B 69/006; E05B 73/00

USPC ..... 211/7, 8, 59.1, 57.1, 54.1, 94.01, 87.01, 211/86.01, 193

See application file for complete search history.

(56) References Cited

U.S. PATENT DOCUMENTS

| | | | | |
|---|---|---|---|---|
| 4,289,242 | A * | 9/1981 | Kenyon | 211/4 |
| 5,027,622 | A * | 7/1991 | Hatch et al. | 70/14 |
| 5,259,220 | A * | 11/1993 | Fredrickson | 70/14 |
| 5,275,027 | A * | 1/1994 | Eklof et al. | 70/14 |
| 5,676,258 | A * | 10/1997 | Leyden et al. | 211/7 |
| 6,003,685 | A * | 12/1999 | Malin | 211/7 |
| 6,957,555 | B1 * | 10/2005 | Nagel et al. | 70/57.1 |
| 7,197,902 | B1 * | 4/2007 | Barkdoll | 70/57.1 |
| 7,269,983 | B1 * | 9/2007 | Mchatet et al. | 70/14 |
| 7,392,673 | B2 * | 7/2008 | Fawcett et al. | 70/14 |
| 7,743,931 | B2 * | 6/2010 | Barkdoll | 211/7 |
| 8,127,946 | B2 * | 3/2012 | Winig et al. | 211/85.1 |
| 8,281,624 | B2 * | 10/2012 | Rizzi | 70/14 |
| 8,667,818 | B1 * | 3/2014 | Mchatet | 70/14 |
| 8,684,227 | B2 * | 4/2014 | Richardson et al. | 221/251 |
| 8,777,020 | B2 * | 7/2014 | Winig et al. | 211/85.1 |
| 2003/0029816 | A1 * | 2/2003 | Huehner et al. | 211/7 |
| 2006/0157431 | A1 * | 7/2006 | Nagelski et al. | 211/54.1 |

(Continued)

*Primary Examiner* — Jennifer E Novosad

(74) *Attorney, Agent, or Firm* — Wood, Phillips, Katz, Clark & Mortimer

(57) ABSTRACT

A securable article display system having a base on a support and an elongate rod cantilever mounted to the base. A blocking assembly defines a receptacle for a part of the rod and is configured so that with the blocking assembly in the engaged state: a) the blocking assembly cannot be separated from the rod by movement relative to the rod transversely to the length of the rod; and b) the blocking assembly is movable along the length of the rod to block an article suspended from the rod from moving past the rod free end. The rod and blocking assembly interact in a manner whereby the rod binds with the blocking assembly as the blocking assembly moves away from the base towards the free end so as to thereby prevent the blocking assembly from moving past the free end to separate from the rod.

21 Claims, 3 Drawing Sheets

(56) References Cited

U.S. PATENT DOCUMENTS

| | | | | |
|---|---|---|---|---|
| 2008/0168811 | A1* | 7/2008 | Nagelski | 70/276 |
| 2009/0057244 | A1* | 3/2009 | Conti et al. | 211/7 |
| 2009/0095695 | A1* | 4/2009 | Moock et al. | 211/57.1 |
| 2010/0199538 | A1* | 8/2010 | Roberts et al. | 40/642.01 |
| 2010/0223965 | A1* | 9/2010 | Richardson et al. | 70/58 |
| 2010/0300992 | A1* | 12/2010 | Surma et al. | 211/7 |
| 2011/0095893 | A1* | 4/2011 | Leyden et al. | 340/572.9 |
| 2013/0105419 | A1* | 5/2013 | Kologe | 211/7 |

* cited by examiner

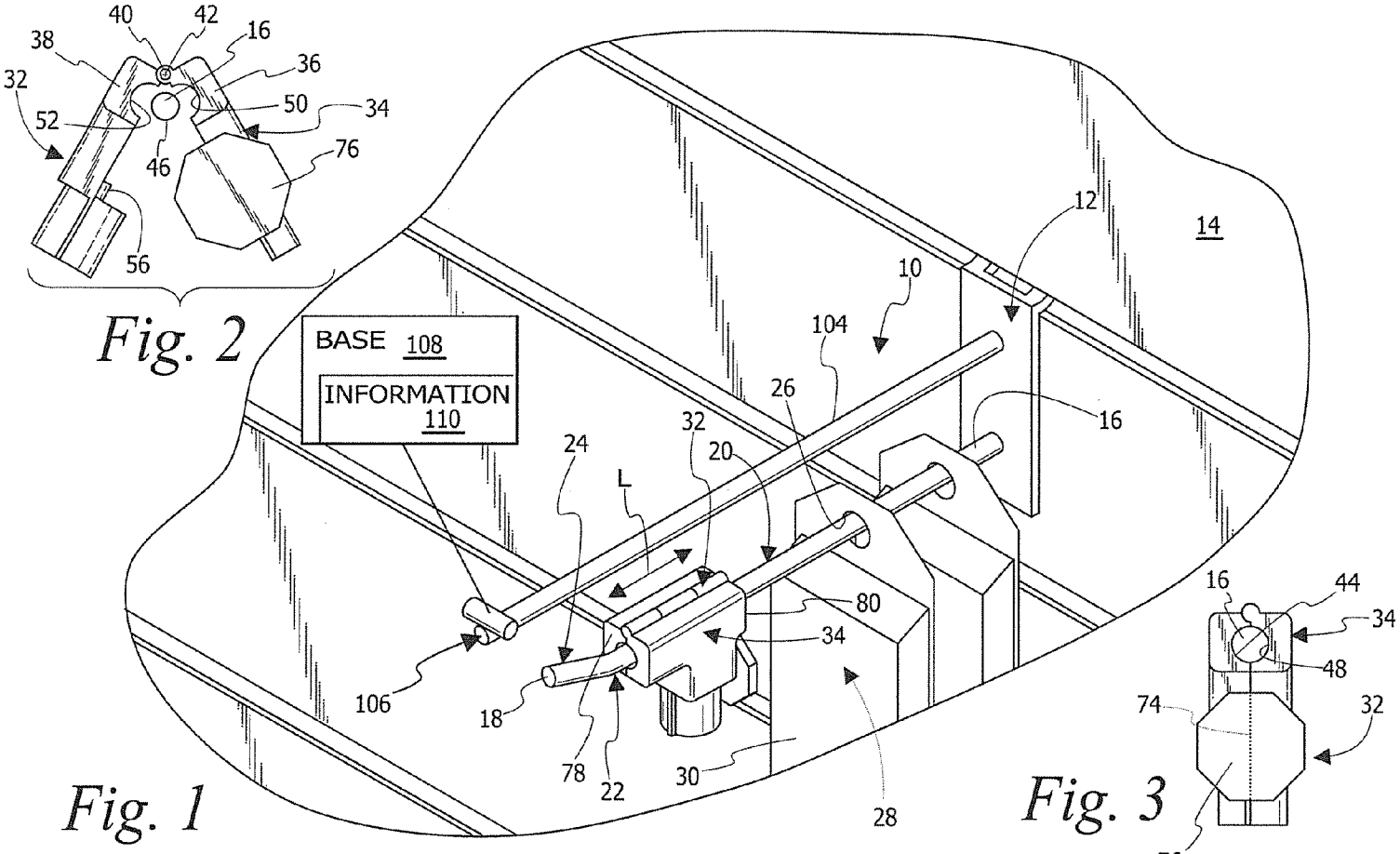
Fig. 1
Fig. 2
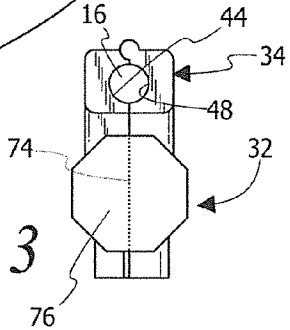
Fig. 3

SECURITY SYSTEM FOR ARTICLES DISPLAYED ON AN ELONGATE ROD

BACKGROUND OF THE INVENTION

1. Field of the Invention

This invention relates to article displays and, more particularly, to a display with an elongate rod from which articles can be hung for display.

2. Background Art

A multitude of different articles are displayed at point of purchase in a hanging position from vertical walls. In one well-known construction, a base component is secured to a wall in a manner whereby the base is either fixed or is movable selectively into different positions. In each case, the base is mounted so that it cannot be readily separated from the wall by a would-be thief.

A first elongate rod is cantilever mounted to the base. The free end of the rod can be directed through fully surrounded openings in the articles themselves and/or in packaging or hangers associated with the individual articles such that the articles can be serially hung from the rod and slid along its length. To prevent inadvertent shifting and separation of the articles from the rod, as when they are placed in bulk into a display state, the distal free end of the first rod is typically provided with some sort of a blocking arrangement. In one form, an enlargement is formed at the free end. Alternatively, or in conjunction with an enlargement, a slight bend may be formed in the rod so that unimpeded sliding of the articles to and past the free end is precluded.

In one design, a second rod is cantilever mounted to the base and projects substantially parallel to, and in a spaced relationship with, the first rod. The second rod, which is typically placed above the first rod, supports product information such as name, descriptive qualities, UPC codes, price, etc.

While this type of display structure is convenient from the standpoint of being easily set up and capable of supporting a large number of articles, it is, in the absence of some additional security measure, an easy target for thieves. This has been well known in the industry, and as a consequence security systems have been developed for use in conjunction with this basic system.

A common form of security system has a housing with a clamshell arrangement with halves movable around a hinge location collectively towards each other to a closed state and away from each other to an open state. The halves cooperatively define a receptacle that has a shape that is complementary to a cooperating rod. With this arrangement, the halves can be placed in the closed state with the rod captive therebetween.

To effect locking of the halves, one of the halves has a spring-loaded metal component that moves in one direction to reside in a receptacle in the other of the halves with the halves in the closed state. This structure positively maintains the halves in their closed state. Store personnel are provided with a magnet that is strategically placed relative to the housing to attract the metal component and draw it oppositely to the first direction to allow the halves to be changed from their closed state into their open state.

With the system set up with the housing halves in their closed state, the housing is slidable along the length of the first rod but is blocked from being separated by moving past the free end thereof by a locally formed enlargement.

In the absence of an enlargement at the rod end, these systems are not practically usable in the sense that they afford no article security. If this type of security system is used on rods with a slight offset angle, and no enlargement, the dimensional relationship between the rod and a receptacle for the rod on the housing is such that the housing can still be slid up to and past the angled end region to be separated from the rod.

As an alternative to using the above-described system, it is also known to wrap a flexible component around the separate rods adjacent their free ends after the articles have been placed for display. This flexible component, which may be a flexible wire, blocks passage of the articles past the free end of the first rod.

However, it is difficult to devise any type of wrapped component that can effectively be secured to both rods so that it might not be readily defeated by a thief.

Further, in the event that the wrapped component cannot be simply and quickly installed, there may be a temptation on the part of store personnel to skip this part of the setup process, as an incident of which the articles become virtually unprotected in the display state and vulnerable to theft.

While the above type of hanger systems abound in all types of stores worldwide, and are used for a wide range of products from very inexpensive to very expensive, the industry has not devised a system that effectively affords reliable security while at the same time being practical to use and affordable to the point that it justifies the investment therein after potential losses have been evaluated for displays without any security feature.

SUMMARY OF THE INVENTION

In one form, the invention is directed to a securable article display system having a base configured to be operatively maintained on a support and an elongate rod having a length and cantilever mounted to the base. The elongate rod has a free end remote from the base and a substantially straight length portion between the base and free end. The straight length portion terminates at a first lengthwise location remote from the base. The elongate rod has a retention portion between the first location and the free end. The elongate rod is configured to pass through an enclosed opening on an article so that the article can be suspended for display from the elongate rod and moved along the straight length portion. The system further includes a blocking assembly which has an engaged state and a release state. The blocking assembly defines a receptacle for a part of the elongate rod and is configured so that with the blocking assembly in the engaged state: a) the blocking assembly cannot be separated from the elongate rod by movement relative to the elongate rod transversely to the length of the elongate rod; and b) the blocking assembly is movable along the straight length portion of the elongate rod to block an article suspended from the elongate rod from moving from the straight length portion to and past the free end. The elongate rod and blocking assembly are configured to interact in a manner whereby the elongate rod binds with the blocking assembly as the blocking assembly moves away from the base towards the free end so as to thereby prevent the blocking assembly from moving past the free end to become separated from the elongate rod.

In one form, the rod has a cross-sectional shape transversely to its length. The cross-sectional shape is substantially the same over the straight length and the retention portion.

In one form, the retention portion is substantially straight between the first location and the free end and has a length that is at an obtuse angle to a line along which the straight length portion extends.

In one form, the blocking assembly includes a housing having first and second parts that are movable relative to each other by pivoting around an axis.

In one form, the housing parts are relatively movable around the axis into the engaged state wherein a part of the elongate rod between the base and first location is captive between the first and second parts.

In one form, with the blocking assembly in the release state, a part of the elongate rod between the base and first location and the housing can be relatively moved in a direction transversely to the length of the elongate rod between: a) a first relationship wherein the housing is fully separated from the elongate rod; and b) a second relationship wherein the part of the elongate rod resides between the first and second parts.

In one form, with the housing parts in the engaged state, the housing parts cooperatively define a receptacle for the part of the elongate rod. The receptacle is configured so that with the housing part in the engaged state the part of the rod can move guidingly within the receptacle parallel to the length of the elongate rod.

In one form, the blocking assembly further includes a locking system for releasably maintaining the housing parts in a relationship wherein the blocking assembly is in the engaged state.

In one form, the locking system includes a locking component that is provided on the first housing part and is changeable between: a) a first position, wherein the locking component blocks relative movement of the housing parts with the blocking assembly in the engaged state; and b) a second position wherein the locking component permits relative movement of the housing parts to permit the blocking assembly to be changed from the engaged state into the release state. The locking system is in a locked state with the locking component in the first position and in an unlocked state with the locking component in the second position.

In one form, the locking component is directed into a receptacle on the second housing part with the blocking assembly in the engaged state and the locking system in the locked state.

In one form, the housing blocks access to the locking component with the blocking assembly in the engaged state and the locking system in the locked state.

In one form, the locking component moves in a path between the first and second positions and is normally urged by a biasing force toward the first position.

In one form, the article display system as described above is provided in combination with a locking system actuator. The locking system actuator includes a component that can be placed strategically adjacent to the housing so as to draw the locking component against the biasing force from the first position into the second position under a magnetic attraction force.

In one form, the receptacle has a length substantially parallel to a length of the straight length portion of the elongate rod with the blocking assembly in the engaged state on the straight length portion. The straight length portion has an outer surface that engages an inner surface bounding the receptacle. The inner and outer surfaces cooperate to guide relative movement between the blocking assembly and rod along the length of the straight length portion.

In one form, the housing bounds the receptacle over the length of the receptacle between first and second housing locations. The housing has a first length between the first and second housing locations. The housing engages the elongate rod at the first and second housing locations with the blocking assembly in the engaged state.

In one form, the first length is at least ⅞ inch.

In one form, the first length is at least 1 inch.

In one form, the securable article display further includes an elongate component that is attached to the base and projects in cantilever fashion from the base. The elongate component has a length substantially parallel to the length of the elongate rod. The elongate component has information thereon relating to a product to be suspended for display on the elongate rod.

In one form, the article display system described above is provided in combination with at least one article suspended for display through the elongate rod.

In one form, with the blocking assembly in the engaged state, the housing parts meet at a parting line. One of the parts has a shield structure that overlies a portion of the parting line.

In one form, the inner and outer surfaces are substantially cylindrical. The inner surface has a diameter slightly greater than a diameter of the outer surface to allow the blocking assembly to be guided along the length of the straight length portion without substantial interference.

BRIEF DESCRIPTION OF THE DRAWINGS

FIG. 1 is a perspective view of a securable article display system, according to the invention, and including an elongate rod with a blocking assembly thereon and shown in an engaged state;

FIG. 2 is an end elevation view of the blocking assembly in relationship to a part of the elongate rod in FIG. 1 and showing cooperating parts of a housing thereon in a first relationship wherein the blocking assembly is in a release state;

FIG. 3 is a view as in FIG. 2 wherein the parts are relatively moved so that the blocking assembly is in an engaged state;

DETAILED DESCRIPTION OF THE PREFERRED EMBODIMENT

Figure 4:
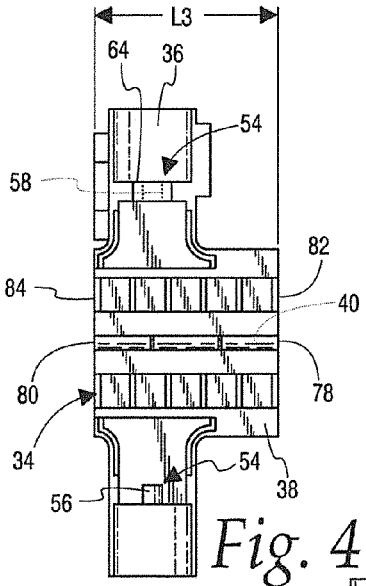
FIG. 4 is a plan view of the blocking assembly in the release state.

In FIGS. 1-11, a securable article display system, according to the present invention, is shown at 10. The display system 10 has a base 12 configured to be operatively maintained on a support 14, in this case a well known type of vertical, slotted wall.

The display system further has an elongate rod 16 with a length as indicated by the double-headed arrow L. The elongate rod 16 is cantilever mounted to the base 12.

The elongate rod 16 has a free end 18 remote from the base 12 and a substantially straight length portion 20 extending from the base 12 toward the free end 18. The straight length portion 20 terminates at a first lengthwise location 22 remote from the base 12. A retention portion 24 is located between the first lengthwise location 22 and free end 18.

The elongate rod 16 is configured to pass through an enclosed opening 26 so that an article 28 can be supported for display from the elongate rod 16, as shown in FIG. 1, and moved guidingly by sliding lengthwise along the elongate rod 16. With this arrangement, at least one article 28, and potentially a plurality of articles 28, can be loaded onto the elongate rod 16 for display by directing the free rod end 18 through the opening 26 and sliding the articles 28 serially towards the base 12. The opening 26 may be in the article 28 itself, or packaging 30 therefor.

The retention portion 24 projects upwardly from the straight length portion 20 and prevents inadvertent sliding of the articles 28 away from the base 12 and past the free end 18 so as to be separated from the elongate rod 16. It is contemplated that the usable portion of the elongate rod consists of at least a majority of the straight length portion 20 upon which the articles 20 can be supported for sliding movement therealong.

The display system 10 further includes a blocking assembly 32 to prevent unauthorized separation of articles 28 from the elongate rod 16. The blocking assembly 32 is configured to move guidingly lengthwise along the straight length portion 20 with the blocking assembly 32 in an engaged state, as shown in FIG. 1. The elongate rod 16, at and adjacent to the retention portion 24, and blocking assembly 32, are configured to interact in a manner whereby the elongate rod 16 binds with the blocking assembly 32 as the blocking assembly 32 moves away from the base 12 towards the free end 18 so as to thereby prevent the blocking assembly 32 from moving past the free end 18 to become separated from the elongate rod 16. So long as the blocking assembly 32 remains in place in the engaged state, any suspended articles 28 between the blocking assembly 32 and base 12 are prevented by the blocking assembly 32 from sliding up to and past the free end 18. To release the articles 28, the blocking assembly 32 must be separated from the elongate rod 16 as described hereinbelow.

More specifically, the blocking assembly consists of a housing 34 with first and second parts 36, 38 joined by a pin 40 for guided relative movement around an axis 42. This produces a clamshell arrangement.

The housing parts 36, 38 cooperatively define a receptacle 44 for a part of the elongate rod 16 that becomes captive between the parts 36, 38 with the blocking assembly in the engaged state. The receptacle 44 is configured to extend around an outer surface 46 on the elongate rod 16. Typically, the outer surface 46 will be cylindrical in shape, though this is not a requirement. Most commonly, the entire elongate rod 16 is made from elongate stock having a constant cross-sectional shape and dimension along its entire length.

The housing 34 has an inner surface 48 bounding the receptacle 44. The inner surface 48 is defined cooperatively by curved inner surface portions 50, 52, respectively on the first and second parts 36, 38. With the blocking assembly 32 in the engaged state, as shown in FIGS. 1 and 3, the inner surface portions 50, 52 cooperatively extend fully around the outer surface 46 of the elongate rod 16. The inner surface portions 50, 52, as depicted, cooperatively produce a substantially cylindrical shape with a diameter slightly greater than a diameter of the cylindrical outer surface 46 to allow the blocking assembly 32 to be guided along the length of the straight length portion 20 of the elongate rod without substantial interference. Of course, any cooperating surface configurations that perform in the same manner might be used without requiring the cylindrical shapes described.

The first and second housing parts 36, 38 can be repositioned relative to each other, from the relationship they have with the blocking assembly in the engaged state, to a relative position as shown in FIG. 2 which represents a release state for the blocking assembly 32. With the blocking assembly 32 in the release state, the blocking assembly 32 and a part of the elongate rod 16, between the base 12 and first location 22, can be relatively moved in a direction transversely to the length of the elongate rod 16 between: a) a first relationship wherein the housing 34 is fully separated from the elongate rod 16; and b) a second relationship wherein the part of the elongate rod 16 resides between the first and second parts 36, 38, as shown in FIG. 2. In the release state, the blocking assembly 32 can be operatively engaged with the elongate rod 16 and separated therefrom.

On the other hand, with the blocking assembly 32 in the engaged state, the blocking assembly 32 cannot be separated from the elongate rod 16, that the housing 34 captively engages, by movement relative to the elongate rod 16 transversely to the length of the elongate rod 16. Rather, the blocking assembly 32 is limited to moving guidingly along the straight length portion 20 of the elongate rod 16 between the base 12 and the retention portion 24.

To set up the display system 10, the blocking assembly 32 is placed in the first relationship with the elongate rod 16 wherein it is fully separated therefrom. Once the articles 28 are placed, the housing 34 is moved from the first relationship with the elongate rod 16 into a second relationship, as shown in FIG. 2, wherein a part of the elongate rod 16 resides between the first and second parts 36, 38. The first and second parts 36, 38 can then be moved fully towards each other until the engaged state for the blocking assembly 32 is realized. The blocking assembly 32 is preferably slidable guidingly, through the interaction of the elongate rod within the receptacle 44, parallel to the length of the elongate rod over the straight length portion 20.

Figure 7:
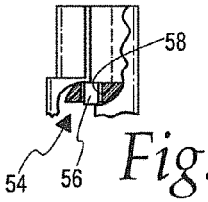
Figure 8:
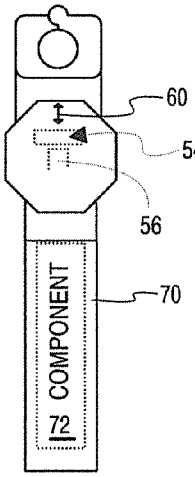
FIG. 8 is a view as in FIG. 3 and showing an actuating component in relationship to the blocking assembly to change the locking system from a locked state into an unlocked state.

To prevent repositioning of the parts 36, 38 and separation of the blocking assembly 32 from the elongate rod 16, with the blocking assembly 32 in its engaged state, a locking system is provided at 54. The locking system 54 consists of a locking component 56 that is provided on one of the first and second housing parts 36, 38, and in this case the second part 38. The locking component 56 is changeable between: a) a first position, as shown in FIG. 7, wherein the locking component 56 blocks relative movement of the housing parts 36, 38 with the blocking assembly 32 in its engaged state; and b) a second position, as shown in FIG. 8, wherein the locking component 56 permits relative movement of the housing parts 36, 38, to thereby allow the blocking assembly 32 to be changed from the engaged state into the release state therefor. The locking system 54 is in a locked state with the locking component 56 in its first position, and an unlocked state with the locking component 56 in its second position.

The locking component 56 is directed into a receptacle 58 on the first housing part 36 with the blocking assembly 32 in the engaged state and the locking system 54 in the locked state.

Figure 6:
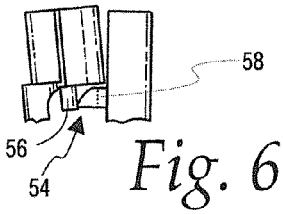

While other designs are contemplated, in this embodiment, the locking component 56 moves in a straight line path, as indicated by the double-headed arrow 60, between its first and second positions, as shown in FIGS. 7 and 6, respectively. A spring 62 normally urges the locking component 56 with a biasing force relative to its associated housing part 38 towards the first position therefor.

Figure 5:
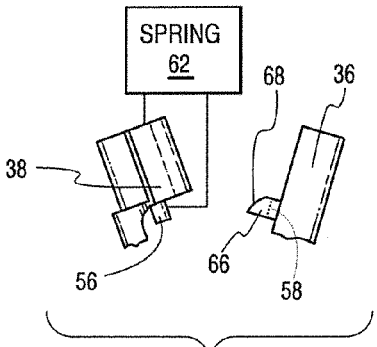
FIGS. 5-7 are fragmentary, end views showing sequentially the interaction between parts on the blocking assembly housing, including parts on a locking system therefor, as the blocking assembly is changed from its release state into its engaged state.

The receptacle 58 for the locking component 56 is formed on a block 64 on the housing part 36. The block 64 has a cantilevered wall portion 66 that resides in the path of the locking component 56 as the housing parts are changed from their FIG. 2 relationship to an abutting relationship wherein the blocking assembly 32 is in the engaged state. This sequence is shown in FIGS. 5-7. As this occurs, the locking component 56 encounters a ramped surface 68 on the wall part 66 that cams the locking component 56 against the spring bias force towards its second position. Continued movement of the housing parts 36, 38 eventually places the locking component 56 in registration with the receptacle 58, whereupon it springs back under the residual spring force to assume its first position, thereby placing the locking system 54 in the locked state.

The housing parts 36, 38 are configured so that the housing fully blocks access to the locking component 56 with the blocking assembly 32 in its engaged state and the locking system 54 in its locked stated.

To effect separation of the blocking assembly 32 with the blocking assembly in the engaged state and the locking system in the locked state, a locking system actuator 70 is required. The locking system actuator 70 has a component 72 that can be placed strategically adjacent to the housing 34 so as to draw the locking component 56 against the biasing force produced by the spring 62, thereby to draw the locking component 56 from its first position into its second position. Preferably this attraction is magnetic attraction. That is, the locking component 56 and actuator component 72 are constructed so that they are mutually attractive. Preferably, the component 72 is magnetized so that the locking component 56 will not reposition in response to exposure to any metal.

With the blocking assembly 32 in the engaged state, the housing parts 36, 38 meet at a parting line 74. To prevent access to the parting line 74 as might permit wedging of the parts 36, 38 away from each other with the blocking assembly 32 in the engaged state therefor, a shield structure 76 is provided on the housing part 36 and overlies at least a portion of the parting line 74 with the locking assembly 32 in the engaged state therefor.

The basic construction described above is typical to prior art structures, as described in further detail hereinbelow. The primary distinction between the inventive blocking assembly 32 and those in the prior art resides in the specific manner in which the blocking assembly 32 is constructed to interact with the elongate rod 16.

In the depicted embodiment, the elongate rod 16 is bent at the first location 22 so that the retention portion 24 is substantially straight over its extent between the first location 22 and the free end 18. A line L1 through the central axis of the retention portion 24 makes an obtuse angle θ to a line L2 through the center of the straight length portion 20.

The receptacle 44 has a length L3 that is substantially parallel to the length of the straight length portion 20 with the blocking assembly 32 on the elongate rod in the engaged state therefor. The housing surface portions 50, 52 bound the receptacle 44 over substantially its entire length L3 between opposite housing ends 78, 80. The housing is configured to surroundingly engage the elongate rod 16 at first and second housing locations 82, 84, spaced from each other a corresponding lengthwise distance L3, as well as over the region therebetween. The spacing between the surfaces 46, 48 is substantially the same over the length L3.

Figure 9:
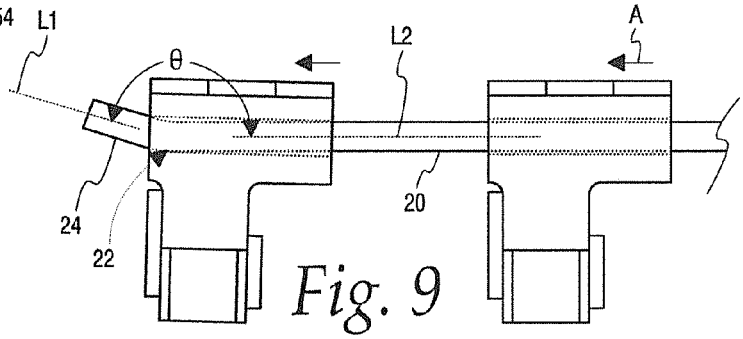
FIG. 9 is a side elevation view of a length of the elongate rod, as shown in FIG. 1, with the blocking assembly in two different lengthwise positions.
Figure 10:
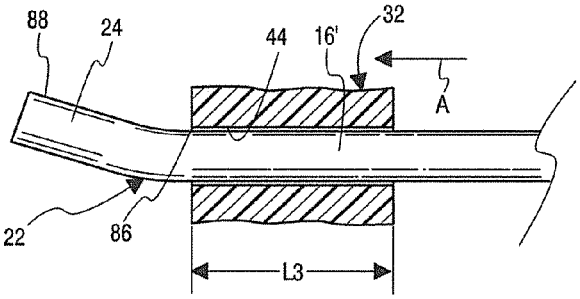
FIG. 10 is an enlarged, fragmentary view of the elongate rod in FIG. 9 and showing the blocking assembly housing in cross-section with the blocking assembly moved towards a retention portion on the elongate rod.
Figure 11:
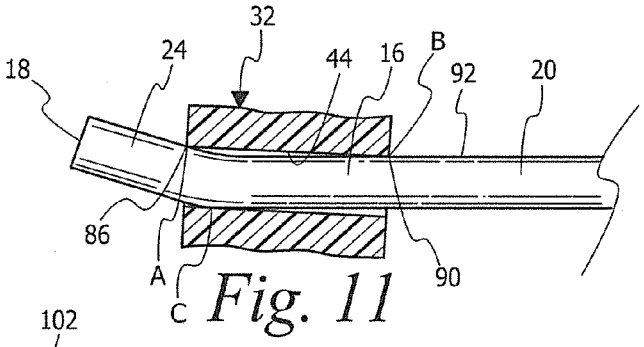
FIG. 11 is a view as in FIG. 10 wherein the blocking assembly movement is arrested by binding of the rod within a receptacle on the blocking assembly housing.

The length L3 is chosen in relationship to the configuration of the elongate rod 16 so that as the blocking assembly 32 is moved from right to left in FIGS. 9-11 up to the retention portion 24, the leading edge 86 of the housing 34, extending around the receptacle 44, encounters the retention portion 24 slightly to the left of the first location 22. Continued advancement of the blocking assembly 32 in the direction of the arrow A (right to left in FIGS. 9-11) causes the edge 86 to ride up the inclined outer surface 88 of the retention portion 24, as shown at FIG. 11, which bears the trailing edge 90, corresponding to the leading edge 86, against the outer surface 92 of the elongate rod 16 along the straight length portion 20. This slight skewing is permitted by reason of there being a slight gap between the inner and outer surfaces 48, 46 that allows them to slide relatively freely, one relative to the other. As this movement occurs, the blocking assembly 32 skews to the point that it becomes wedged in the FIG. 11 position. In other words, the blocking assembly 32 bridges the elongate rod at spaced locations A and B, respectively on the straight length portion 20 and retention portion 24, while engaging a diametrically opposite rod location at C. The elongate rod 16 thereby binds with and wedges into the blocking assembly 32 to prevent the blocking assembly 32 from moving in the direction of the arrow A to an extent that might eventually allow it to reach the free end 18 and separate from the elongate rod 16.

Figure 12:
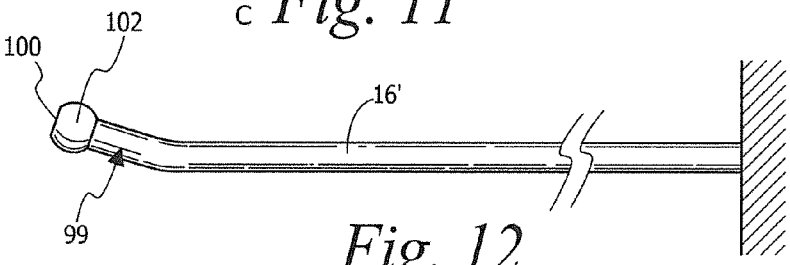
Fig. 12 Prior Art
FIG. 12 is a side elevation view of a prior art elongate rod mounted to a vertical support.
Figure 13:
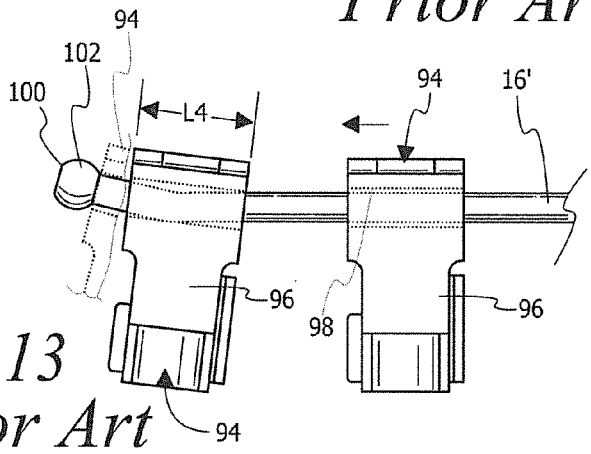
Fig. 13 Prior Art
FIG. 13 is a fragmentary view of the elongate rod in FIG. 12 and showing a prior art blocking assembly in different positions moving up to a free end of the elongate rod at which an enlargement is formed.

FIGS. 12 and 13 depict a prior art blocking assembly 94 of the type over which the inventive blocking assembly 32 improves. The blocking assembly 94 is structurally similar to the blocking assembly 32 in a general sense in terms of having a housing 96 with parts that are hinged and capture the elongate rod 16' depicted.

The prior art blocking assembly 94 is configured by selecting a configuration for the housing 96, including a length L4, corresponding to the length L3 in the inventive blocking assembly 32, and a receptacle 98, corresponding to the receptacle 44, that will allow the blocking assembly 32, when slightly skewed, as the leftmost blocking assembly 94 in FIG. 13, to transition to and traverse to an angled retention portion 99 up to a location adjacent the free end 100, as shown in dotted lines in FIG. 13. This is made possible in part by having the dimension L4 less than the length L3. The housing 96 with this shorter dimension will not bridge angled parts of the elongate rod 16' at locations adequately spaced so as to produce the same binding/wedging action resulting from the inventive design. The configuration of the receptacle 98, in relationship to that of the rod 16', also makes this possible.

To prevent separation of the blocking assembly 94 from the elongate rod 16', an enlargement 102 is provided to abut the blocking assembly 94, as shown in dotted lines in FIG. 13. In the absence of the end enlargement 102, the blocking assembly 94 in an engaged state might slide lengthwise of the elongate rod 16' to separate therefrom.

Preferably, the housings for the prior art and inventive blocking assemblies are made from a moldable, non-metal material. Such materials will deform to some extent around the rod receptacles as the blocking assemblies are urged lengthwise towards the free ends of the associated elongate rods. However, even with this slight material deformation, the housing 32 is configured so that it cannot transition to and traverse the retention portion 24 without an excessive force that would effectively destroy the housing 32.

On the other hand, the prior art blocking assemblies 94 have been made with a short enough dimension L4, and a large enough gap between the elongate rod 16' and the housing surface bounding the receptacle for the elongate rod 16' that the blocking assemblies 94 can reposition and move readily along an angled end portion up to the enlargement 102, which becomes solely responsible for preventing movement of the blocking assembly 94 past the free end 106 of the elongate rod 16'.

The precise dimensions for the inventive blocking assembly 32 depend upon the configuration of the retention portion 24. Typically, the length L4 will be on the order of ⅞ inches or greater, and more preferably 1 inch or greater, using conventional elongate rod configurations. Significantly, the configuration of the housing, including the receptacle 44, is selected so that regardless of the precise configuration of the retention portion 24, the blocking assembly 32 can at best skew slightly, as shown in the transition between FIGS. 10 and 11. However, the elongate rod 16 is bridged by the blocking assembly housing at a location spaced adequately that the elongate rod 16 binds/wedges within the receptacle to preclude advancement of the blocking assembly 32 to the free end 18. Accordingly, there is no need to provide an enlargement at the free end 18 as in the prior art structures. This permits formation of the retention portion 24 by a simple bending step. Of course, other configurations for retention portions are contemplated.

The display system 10, as shown in FIG. 1, further has an upper elongate component 104 that is attached to the base 12 and projects in cantilever fashion therefrom. The elongate component 104 has a length substantially parallel to the length of the elongate rod 16 and projects towards the free end 18. As depicted, the free end 106 of the component 104 projects past the free end 18 and provides a support for a card or other base 108 upon which product information 110 can be provided.

Figure 14:
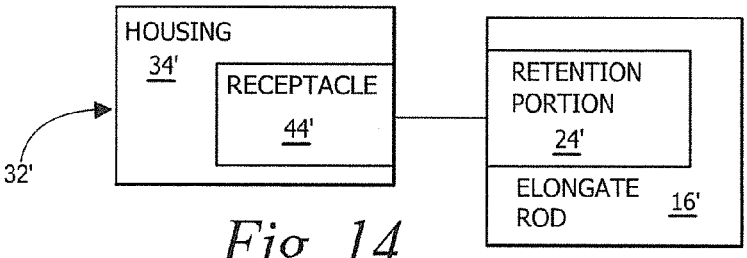
FIG. 14 is a schematic representation of a securable article display system according to the present invention.

As indicated in schematic form in FIG. 14, the invention contemplates that the inventive blocking assembly, shown generically at 32' in FIG. 14, may include any type of housing 34' that can be slidably operatively engaged with an elongate rod 16". What is significant is that the housing 34' and receptacle 44' be defined in relationship to a retention portion 24' on the elongate rod 16" so that the elongate rod 16" will bind/wedge within the receptacle 44' at or along a portion of the retention portion 24', thereby precluding separation of the housing 34' from the elongate rod 16". This can be done without requiring any enlargements at the free end of the elongate rod 16". This makes possible a more inexpensive elongate rod configuration.

The invention is not concerned with the precise manner in which the elongate rod 16, 16', 16" is mounted upon the support 14. It is conceivable that the elongate rod 16, 16', 16" might actually be placed upon a horizontal surface to project vertically. Further, the component 104 is not required for the display system 10.

The schematic showing of components in FIG. 14 is intended to encompass the specific component configurations herein, and virtually an unlimited number of variations thereof, that would be apparent to one skilled in this art with the teachings herein in hand.

As an example, while in the FIG. 1 depiction, the elongate rod 16 and component 104 are shown as formed from a continuous piece, these parts could be separately formed and attached to the base 12 in any manner.

The foregoing disclosure of specific embodiments is intended to be illustrative of the broad concepts comprehended by the invention.

The invention claimed is:

1. A securable article display system comprising: a base configured to be operatively maintained on a support;

an elongate rod having a length and cantilever mounted to the base, the elongate rod having a forward free end remote from the base and a substantially straight length portion between the base and free end, the straight length portion terminating at a first lengthwise location remote from the base, the elongate rod having a retention portion between the first location and the free end, the elongate rod configured to pass through an enclosed opening on an article so that the article can be suspended for display from the elongate rod and moved along the straight length portion; and a blocking assembly, the blocking assembly configured to be placed in an engaged state and a release state that is different than the engaged state, the blocking assembly defining a receptacle for a part of the straight length portion of the elongate rod and configured so that with the blocking assembly in the engaged state: a) the blocking assembly cannot be separated from the elongate rod by movement relative to the elongate rod transversely to the length of the elongate rod; and b) the blocking assembly is movable along the straight length portion of the elongate rod to block an article suspended from the elongate rod from moving from the straight length portion to and past the free end;

the elongate rod at and adjacent to the retention portion and blocking assembly configured to interact in a manner whereby the elongate rod binds with the blocking assembly as the blocking assembly moves away from the base towards the free end so as to thereby prevent the blocking assembly from moving past the free end to become separated from the elongate rod;

wherein the retention portion is substantially straight between the first location and the free end and has a length that is at an obtuse angle to a line along which the straight length portion extends so as to extend forwardly and upwardly from the straight length portion of the elongate rod.

2. The article display system according to claim 1 wherein the rod has a cross-sectional shape transversely to the length and the cross-sectional shape is substantially the same over the straight length and the retention portion.

3. The article display system according to claim 1 wherein the blocking assembly comprises a housing, the housing comprising first and second parts that are movable relative to each other by pivoting around an axis.

4. The article display system according to claim 3 wherein the housing parts are relatively movable around the axis into the engaged state wherein a part of the elongate rod between the base and first location is captive between the first and second parts.

5. The article display system according to claim 4 wherein the blocking assembly further comprises a locking system for releasably maintaining the housing parts in a relationship wherein the blocking assembly is in the engaged state.

6. The article display system according to claim 5 wherein the locking system comprises a locking component that is provided on the first housing part and is changeable between: a) a first position, wherein the locking component blocks relative movement of the housing parts with the blocking assembly in the engaged state; and b) a second position wherein the locking component permits relative movement of the housing parts to permit the blocking assembly to be changed from the engaged state into the release state, the locking system in a locked state with the locking component in the first position and in an unlocked state with the locking component in the second position.

7. The article display system according to claim 6 wherein the locking component is directed into a receptacle on the second housing part with the blocking assembly in the engaged state and the locking system in the locked state.

8. The article display system according to claim 3 wherein with the blocking assembly in the release state a part of the elongate rod between the base and first location and the housing can be relatively moved in a direction transversely to the length of the elongate rod between: a) a first relationship wherein the housing is fully separated from the elongate rod; and b) a second relationship wherein the part of the elongate rod resides between the first and second parts.

9. The article display system according to claim 4 wherein with the housing parts in the engaged state, the housing parts cooperatively define a receptacle for the part of the elongate rod, the receptacle configured so that with the housing part in the engaged state the part of the rod can move guidingly within the receptacle parallel to the length of the elongate rod.

10. The article display system according to claim 9 wherein the receptacle has a length substantially parallel to a length of the straight length portion of the elongate rod with the blocking assembly in the engaged state on the straight length portion, the straight length portion having an outer surface that engages an inner surface bounding the receptacle, the inner and outer surfaces cooperating to guide relative movement between the blocking assembly and rod along the length of the straight length portion.

11. The article display system according to claim 10 wherein the housing bounds the receptacle over the length of the receptacle between first and second housing locations, the housing has a first length between the first and second housing locations, and the housing engages the elongate rod at the first and second housing locations with the blocking assembly in the engaged state.

12. The article display system according to claim 11 wherein the first length is at least ⅞ inch.

13. The article display system according to claim 11 wherein the first length is at least 1 inch.

14. The article display system according to claim 3 wherein with the blocking assembly in the engaged state the housing parts meet at a parting line and one of the parts has a shield structure that overlies a portion of the parting line.

15. The article display system according to claim 1 wherein the securable article display further comprises an elongate component that is attached to the base and projects in cantilever fashion from the base, the elongate component having a length substantially parallel to the length of the elongate rod, the elongate component having information thereon relating to a product to be suspended for display on the elongate rod.

16. The article display system according to claim 15 in combination with at least one article suspended for display using the elongate rod.

17. A securable article display system comprising:

a base configured to be operatively maintained on a support;

an elongate rod having a length and cantilever mounted to the base, the elongate rod having a free end remote from the base and a substantially straight length portion between the base and free end, the straight length portion terminating at a first lengthwise location remote from the base, the elongate rod having a retention portion between the first location and the free the elongate rod configured to pass through an enclosed opening on an article so that the article can be suspended for display from the elongate rod and moved along the straight length portion; and a blocking assembly, the blocking assembly configured to be placed in an engaged state and a release state that is different than the engaged state, the blocking assembly defining a receptacle for a part of the elongate rod and configured so that with the blocking assembly in the engaged state: a) the blocking assembly cannot be separated from the elongate rod by movement relative to the elongate rod transversely to the length of the elongate rod; and b) the blocking assembly is movable along the straight length portion of the elongate rod to block an article suspended from the elongate rod from moving from the straight length portion to and past the free end, the elongate rod at and adjacent to the retention portion and blocking assembly configured to interact in a manner whereby the elongate rod binds with the blocking assembly as the blocking assembly moves away from the base towards the free end so as to thereby prevent the blocking assembly from moving past the free end to become separated from the elongate rod, wherein the blocking assembly comprises a housing, the housing comprising first and second parts that are movable relative to each other by pivoting around an axis, wherein the housing parts are relatively movable around the axis into the engaged state wherein a part of the elongate rod between the base and first location is captive between the first and second parts, wherein the blocking assembly further comprises a locking system for releasably maintaining the housing parts in a relationship wherein the blocking assembly is in the engaged state, wherein the locking system comprises a locking component that is provided on the first housing part and is changeable between: a) a first position, wherein the locking component blocks relative movement of the housing parts with the blocking assembly in the engaged state; and b) a second position wherein the locking component permits relative movement of the housing parts to permit the blocking assembly to be changed from the engaged state into the release state, the locking system in a locked state with the locking component in the first position and in an unlocked state with the locking component in the second position, wherein the locking component is directed into a receptacle on the second housing part with the blocking assembly in the engaged state and in the locking system in the locked state, wherein the housing blocks access to the locking component with the blocking assembly in the engaged state and the locking system in the locked state.

18. The article display system according to claim 17 wherein the locking component moves in a path between the first and second positions the article display system configured so that the locking component is normally urged by a biasing force toward the first position.

19. The article display system according to claim 18 in combination with a locking system actuator, the locking system actuator comprising a component that can be placed adjacent to the housing in a manner so as to draw the locking component against the biasing force from the first position into the second position under a magnetic attraction force.

20. The article display system according to claim 19 wherein the inner and outer surfaces are substantially cylindrical and the inner surface has a diameter slightly greater than a diameter of the outer surface to allow the blocking assembly to be guided along the length of the straight length portion without substantial interference.

21. A securable article display system comprising: a base configured to be operatively maintained on a support;

an elongate rod having a length and cantilever mounted to the base, the elongate rod having a free end remote from the base and a substantially straight length portion between the base and free end, the straight length portion terminating at a first lengthwise location remote from the base, the elongate rod having a retention portion between the first location and the free end, the elongate rod configured to pass through an enclosed opening on an article so that the article can be suspended for display from the elongate rod and moved along the straight length portion; and a blocking assembly, the blocking assembly configured to be placed in an engaged state and a release state that is different than the engaged state, the blocking assembly defining a receptacle for a part of the elongate rod and configured so that with the blocking assembly in the engaged state: a) the blocking assembly cannot be separated from the elongate rod by movement relative to the elongate rod transversely to the length of the elongate rod; and b) the blocking assembly is movable along the straight length portion of the elongate rod to block an article suspended from the elongate rod from moving from the straight length portion to and past the free end, the elongate rod at and adjacent to the retention portion and blocking assembly configured to interact in a manner whereby a portion of the retention portion moves into the receptacle on the blocking assembly and the elongate rod binds with the blocking assembly as the blocking assembly moves away from the base towards the free end so as to thereby prevent the blocking assembly from moving past the free end to become separated from the elongate rod.

* * * * *